US010943751B2

(12) United States Patent
Elsinger et al.

(10) Patent No.: US 10,943,751 B2
(45) Date of Patent: Mar. 9, 2021

(54) ELECTROMAGNETIC RELAY

(71) Applicant: PANASONIC INDUSTRIAL DEVICES EUROPE GMBH, Lüneburg (DE)

(72) Inventors: Herbert Elsinger, Unterhaching (DE); Markus Bichler, Weyarn (DE)

(73) Assignee: PANASONIC INDUSTRIAL DEVICES EUROPE GMBH, Lüneburg (DE)

( * ) Notice: Subject to any disclaimer, the term of this patent is extended or adjusted under 35 U.S.C. 154(b) by 239 days.

(21) Appl. No.: 16/334,687

(22) PCT Filed: Sep. 11, 2017

(86) PCT No.: PCT/EP2017/072770
§ 371 (c)(1),
(2) Date: Mar. 19, 2019

(87) PCT Pub. No.: WO2018/054714
PCT Pub. Date: Mar. 29, 2018

(65) Prior Publication Data

US 2020/0203104 A1 Jun. 25, 2020

(30) Foreign Application Priority Data

Sep. 20, 2016 (DE) ..... 10 2016 117 671.0

(51) Int. Cl.
*H01H 50/04* (2006.01)
*H01H 50/58* (2006.01)
(Continued)

(52) U.S. Cl.
CPC ..... *H01H 50/041* (2013.01); *H01H 50/20* (2013.01); *H01H 50/36* (2013.01);
(Continued)

(58) Field of Classification Search
CPC ..... H01H 50/041; H01H 50/20; H01H 50/36; H01H 50/443; H01H 50/58; H01H 50/643; H01H 2050/028; H01H 51/2272
See application file for complete search history.

(56) References Cited

U.S. PATENT DOCUMENTS 3,906,416 A 9/1975 Sprando
4,625,191 A 11/1986 Oberndorfer et al.
(Continued)

FOREIGN PATENT DOCUMENTS

DE 92 08 114 U1 10/1992
DE 10 2012 207 589 B3 10/2013
EP 1 418 606 A1 5/2004

OTHER PUBLICATIONS

International Search Report issued in PCT/EP2017/072770; dated Dec. 22, 2017.

*Primary Examiner* — Mohamad A Musleh
(74) *Attorney, Agent, or Firm* — Studebaker & Brackett PC

(57) ABSTRACT

The invention relates to an electromagnetic relay (1), more particularly a safety relay (1). This has a main body (10) and a coil system (20, 120) located thereon, the coil system (20, 120) having a coil (24, 124) and a yoke (25, 125) which extends through the coil (24, 124) along a winding axis (WA) of the coil (24, 124). An armature (30, 130) for the relay (1) is located next to the coil (24, 124) and mounted such that it can pivot about an armature bearing axis (AA, AA') and has pole shoes (33*a*, 33*b*, 33*c*, 33*d*, 133*a*, 133*b*) for magnetically coupling with the yoke (25, 125) of the coil system (20, 120). The relay (1) also comprises a contact system (50) having at least two contact springs (51, 53), wherein each spring movement plane (FB) of the contact springs (51, 53) extends across the winding axis (WA) of the coil (24, 124), preferably at a substantially right angle. At
(Continued)

Figure 1:
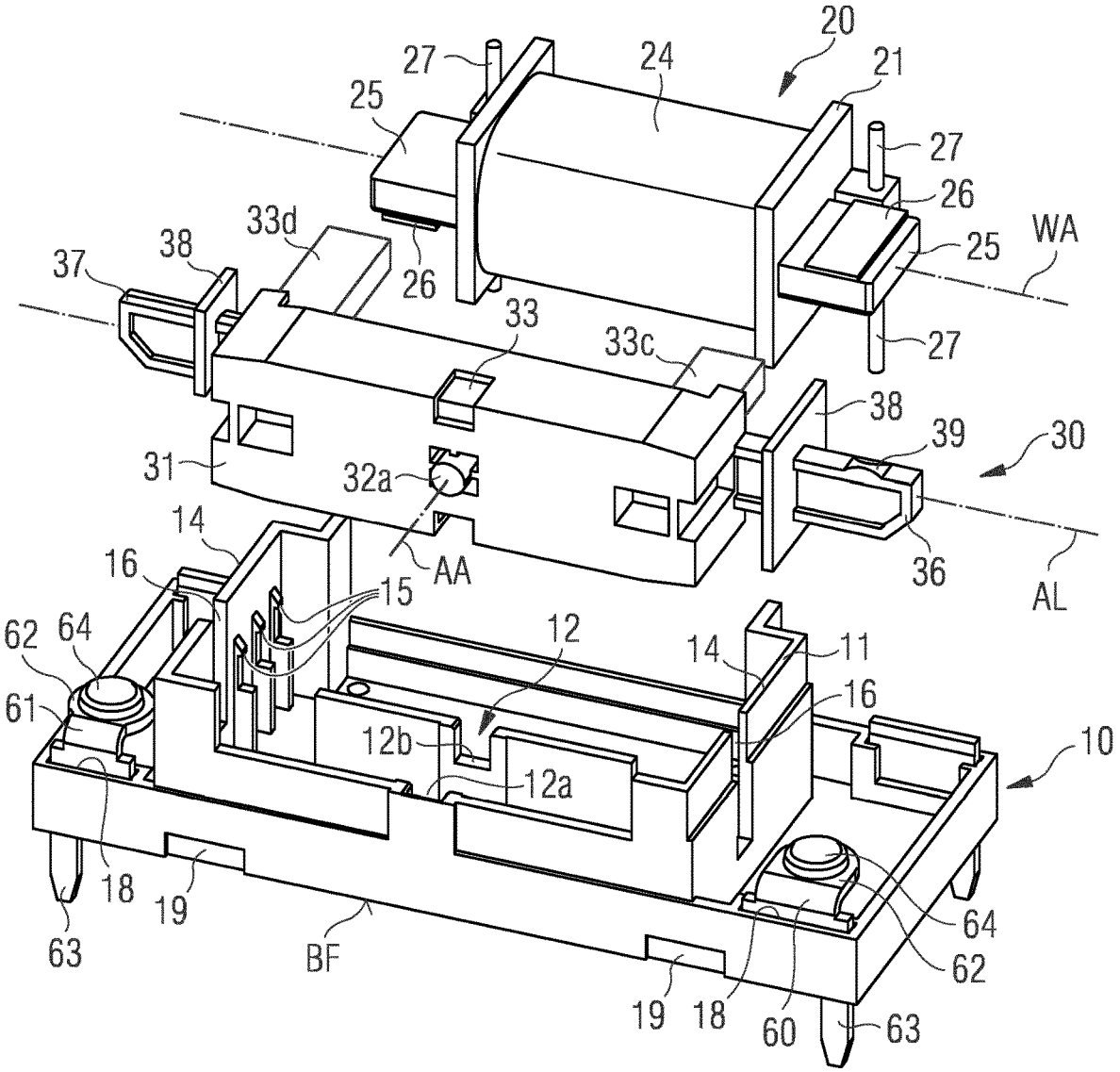

least two actuators (36, 37, 41, 42) are located on the armature (30, 130), which actuators (36, 37, 41,42) are allocated to the contact springs (51, 53) in order to actuate same and which actuators (36, 37, 41, 42) extend radially outwards on the armature (30, 130) with respect to the armature bearing axis (AA, AA') in a longitudinal direction (AL) of the armature (30, 130), wherein the radially outermost ends of the two actuators (36, 37, 41, 42) are farther away from the armature bearing axis (AA, AA') than the pole shoes (33*a,* 33*b,* 33*c,* 33*d,* 133*a,* 133*b*) of the armature (30,130).

15 Claims, 9 Drawing Sheets

(51) Int. Cl.
*H01H 50/20* (2006.01)
*H01H 50/36* (2006.01)
*H01H 50/44* (2006.01)
*H01H 50/64* (2006.01)

(52) U.S. Cl.
CPC ..... *H01H 50/443* (2013.01); *H01H 50/58* (2013.01); *H01H 50/643* (2013.01)

(56) References Cited

U.S. PATENT DOCUMENTS 4,743,877 A * 5/1988 Oberndorfer ..... H01H 50/58 335/128
8,203,403 B2 * 6/2012 Moeller ..... H01H 50/642 335/78
8,514,040 B2 * 8/2013 Gruner ..... H01H 51/2263 335/177

* cited by examiner

ELECTROMAGNETIC RELAY

The invention relates to an electromagnetic relay, in particular, a safety relay, with a main part, a coil system arranged on the main body with a coil and a yoke, which extends along a winding axis of the coil through this, as well as with an armature, which is arranged in a pivotably mounted manner on an armature bearing axis and which comprises pole shoes for magnetically coupling with the yoke of the coil system, and with a contact system with at least two contact springs, whereby actuators are arranged on the armature, which are allocated to the contact springs in order to actuate the contact springs during a movement of the armature, meaning opening or closing the corresponding contacts of the contact springs by moving the contact springs.

Various designs of such relays are known from practice. In the case of a design as a safety relay, at least one of the contact springs is allocated to a so-called break contact or normally closed contact (also called "NC contact", NC=normally closed) and at least one other contact spring is allocated to the normally open contact (also called "NO contact", NO=normally open). Due to a forced guidance or by means of an appropriate arrangement of the actuators on the armature, it is ensured that the NC contact and the NO contact cannot be closed simultaneously. In particular, the arrangement is such that the opening of the NC contact also precedes the closing of the NO contact and this does not occur at all simultaneously or vice versa. If an "opening failure" occurs when opening the NC contact, because the contact spring of the NC contact is welded to the counter contact, the NO contact cannot be closed. Thereby, an opening failure can be securely detected by the open (mechanically connected) NO contact. For safety relays (relays with forcibly guided contacts in accordance with IEC 61810-3), it is additionally required that, in the case of an opening failure of an NO contact, the NC contact, and also in the case of an opening failure of a NC contact, the NO contact, must always have a specified minimum contact distance, namely at least 0.5 mm.

The contact springs of the contact system must therefore have a relative high level of stroke, which leads to corresponding path lengths of the actuators. In turn, this requires a sufficiently large construction of the entire relay. On the other hand, it is desirable for many applications to have relays with corresponding safety requirements with the smallest external dimensions as possible. In particular, in the case of many constructions, it is favourable if the relay is relatively flat, meaning that the design height of a relay is relatively low when positioning it on a circuit board.

It is therefore an object of the present invention to create a relay, which, in particular, can be used as a safety relay and which, however, has very small outer dimensions, more preferably being able to be arranged in a particularly flat manner on a circuit board.

This task is achieved by means of a relay in accordance with Patent Claim 1.

As has been mentioned beforehand, the electromagnetic relay comprises a main body and a coil system arranged on the main body with at least one coil and a yoke, which extends along a winding axis, meaning the longitudinal axis, of the coil through this. For example, such a coil system and such a coil assembly can be built by initially overmoulding the yoke with plastic under the formation of a coil core within the scope of an injection-moulding method and the coil core or the coil body is then wrapped around with the coil wire in order to form the coil.

Furthermore, the electromagnetic relay comprises an armature, which is arranged next to the coil, meaning outside the coil, pivotably mounted around an armature bearing axis, and which comprises the pole shoe for magnetically coupling with the yoke of the coil system. In the case of this construction, the yoke of the coil system is static and is magnetically polarized in such a way by applying a voltage to the winding of the coil accordingly so that the pole shoes of the armature in the rest position are initially repelled due to their coupling with one or a plurality of permanent magnets and then attracted in the counter position (the operating position), which results in the armature moving around the armature bearing axis.

Furthermore, the electromagnetic relay comprises a contact system with at least the two above-mentioned contact springs. Thereby, the arrangement of these contact springs is such that a spring movement plane, on which the flexible contact springs and the moveable springy part of the contact springs respectively extend along a main extension direction, transversely, preferably running at a substantially right angle to the winding axis of the coil. The "spring movement plane" can be defined here in such a way that the moveable part of the contact spring moves from the open position into the closed position of the contact on this plane and passes over a surface on this plane. If, for example, it has to do with a contact spring (e.g. with an L-shaped structure), the springy arm of which extends from one fixed connection point (e.g. the winding point of the L-shape) towards the counter contact, the spring movement plane can be defined by this fixed connection point, the point at which the contact is closed and the point at which the contact head of the spring is in the open state. Under "main extension direction", here, the direction is understood, in which a moveable part or a flexible arm of the contact spring primarily extends.

Here, the contact system can comprise at least two contacts, namely an NC contact and an NO contact for example, which each comprise at least one of these contact springs and a corresponding counter contact. Thereby, the counter contact is preferably a stationary, i.e. a primarily fixed, contact body, against which the flexible contact spring is pressed to close the contact or lifted away from this. Thereby, the contact spring is then moved on the spring movement plane and flexibly bent away from the counter contact or bent towards the counter contact depending on which construction is precisely at hand. In the case of this arrangement of the spring movement plane and of the main extension direction of the flexible contact springs and of the winding axis (when viewing the relay from the top), the projections of the main extension direction and of the longitudinal axis of the contact springs and the projections of the winding axis run transversely and preferably perpendicular to each other onto a base area of the main body, with which this base body is, in turn, arranged on a circuit board in the assembled state.

According to the invention, at least two actuators are arranged on the armature, which are each allocated to the contact springs to actuate the contact springs, meaning, they act on these contact springs and the moveable flexible parts of the contact springs, thereby being able to move the contact springs on the spring movement plane. On the armature, with reference to the armature bearing axis, these actuators extend outwardly in a radial manner in a longitudinal direction of the armature, meaning away from the armature bearing axis outwardly. Thereby, the radially outermost ends of both actuators (viewed in the longitudinal direction of the armature) are further away from the armature bearing axis than the pole shoe of the armature.

Due to the fact that the actuators or the actuator arms for both contacts on opposite ends of the armature extend diametrically in an outward manner away from the armature bearing, the advantage results that a relatively great level of stroke exists despite a flat construction of the relay. Likewise, the arrangement of the armature next to the coil supports a flat construction. Therefore, in the case of a flat construction, a great distance of the contact springs from the counter contacts can be implemented. As a result, as will be explained later on, the relay can be designed as a safety relay and, in particular, the contact springs on the opposite ends of the armature can be allocated to an NC contact and a related NO contact since the contact springs can be forcibly guided via the armature.

Accordingly, the relay according to the invention is preferably used as a safety relay in a safety circuit.

Other especially favourable embodiments and further embodiments of the invention result from the dependent claims as well as the following description, wherein the features of different exemplary embodiments can also be combined into new exemplary embodiments.

Preferably, the relay is constructed in such a way that the spring movement plane of at least one of the contact springs primarily runs parallel to the armature bearing axis, meaning that the armature bearing axis runs in parallel to the spring movement plane at the usual tolerances. In the case of such a construction, the main extension direction of the contact spring concerned primarily runs parallel to the armature bearing axis in the sense that the projections of the longitudinal axis of the contact spring and the armature bearing axis run in parallel on the base area of the main body of the relay. In other words, when viewing the relay from the top, both longitudinal axes of the contact spring and the armature bearing axis then run in parallel and preferably, the winding axis of the coil runs perpendicularly. pendicularly. Due to the fact that the contact springs and the armature bearing axis primarily run in parallel to each other, a particularly space-saving construction is achieved.

Preferably, the spring movement planes of both contact springs primarily run in parallel to one another.

Furthermore, for the desired flat arrangement, it is of an advantage if the armature bearing axis runs through the coil in its intended extension. However, whether there is a height offset between the intended extension of the armature bearing axis and of the winding axis depends on the exact construction of the armature.

If, for example, in the case of a preferred variation, an H-shaped armature is used, which has a total of four pole shoes that are arranged in such a way that two pole shoes always wrap around an end of the yoke of the coil system and consequently, two pole shoes are in contact with a pole surface of the yoke on opposite sides of the yoke, it is therefore preferred if the armature bearing axis in its extension and the yoke centre axis intersect. In another preferred variation of the armature, where this only has two pole shoes and only one pole shoe is always in contact with a pole surface of the yoke, the armature bearing axis can lie in such a way that it, with reference to the base area of the main body of the relay, is shifted to a different height with relation to the yoke centre axis. In particular, it is possible to then arrange the armature bearing axis under the joke centre axis, meaning between the yoke centre axis and the base area of the main body of the relay. The armature bearing axis can, however, also be above the yoke centre axis, meaning between the yoke centre axis and the upper side of the housing.

Preferably, in both cases, the armature is designed in such a way that the pole shoes are bent and kinked from the longitudinal direction of the armature towards the coil.

This is, for example, possible by the armature comprising U-shaped bodies as effective cores or core elements, which form pole shoes on the end side. In the case of an armature with only two pole shoes, only a U-shaped core element is necessary. For example, an H-shaped armature is constructed on each end of two oppositely located pole shoes, two such U-shaped core elements can be laid on top of each other so that the pole shoes of both U-shaped core elements each wrap around the ends of the yoke in a fork-shaped manner. Due to the armature's pole shoes kinked or bent towards the coil or towards the yoke, it is possible to design the pole shoe surfaces as large as possible so that a best-possible magnetic flow is achieved. Apart from that, the U-shaped core elements can also have U-shaped limbs with unequal lengths. It would also be conceivable that the pole shoes of the yoke are bent towards the armature and the armature does not comprise any or only a small bending. Along the same lines, a combination of both variations is possible since, with respect to the size of the covering of the pole shoes, the requirements can be different in an energized or de-energized position.

The core elements can themselves be permanent magnets. Preferably, in the case of these U-shaped core elements, it has to do with iron parts, in particular, soft-iron parts.

Permanent magnets can be built into the armature body, which provide for a magnetic flux through the soft-iron core elements.

As was initially mentioned, the actuators extend outwardly viewed in the longitudinal direction of the armature over the pole shoes away from the armature bearing axis. Preferably, these actuators are permanently connected to the armature, particularly in a rotationally fixed manner. Being especially preferred in particular, they are designed as a single piece with the armature, for example, created together with the armature by means of an injection-moulding method.

In the case of a very inexpensive and simple way of manufacturing the armature, the core element or the core elements (and, if applicable, also the permanent magnets, provided they are not subsequently glued into compartments introduced within the scope of an injection-moulding method for this very purpose separately) are moulded over in an injection-moulding method to produce the armature body, wherein, simultaneously, the actuators, tors, for example, in the form of actuator arms or a type of end-side stubs, are moulded onto the armature body.

In the case of a particularly preferred embodiment, the actuators are respectively formed and arranged on the armature and the contact springs are respectively formed and arranged in such a way that a contact spring is pressed away from a counter contact allocated to the respective contact spring by the actuator allocated to it in order to open the contact concerned. In the case of such a "lift-off contact", the actuator lifts the contact head of the contact spring, meaning the part of the contact spring coming into contact with the counter contact, away from the counter contact on the movement plane.

It is particularly favourable if the contact springs extend transversely and, favourably, perpendicularly to the armature longitudinal axis in a bridge-like manner across the actuator arms. Viewed from the base area, the contact springs run above the armature longitudinal axis and the contact springs are pressed away in an upward manner for opening.

The arrangement is especially preferred in particular if the actuator is still at somewhat of a distance from the contact spring in the receptively closed state of the contact, meaning, in this position, it does not come into contact with the contact spring. This has the advantage that, over time, the contact elements between the contact spring and the counter contact could somewhat burn off and, despite this, the contact is also securely closed in the closed state.

As has already been mentioned, an armature bearing is on the main body, in which the armature is pivotably mounted around the armature bearing axis. Thereby, it is particularly favourable if the armature bearing, on the one hand, and the at least two contact springs, on the other, are arranged on sides of the armature opposite to each other with the actuators. If, as is described above, the contact springs each engage (viewed from the base area) the armature above the actuators, meaning the actuators grip under the contact springs, the armature bearing should preferably be below the armature and engage from beneath the armature. For example, armature bearing pins running in the armature bearing axis accordingly could be formed on the armature body and these armature bearing pins are pressed into the armature bearing in the main body from above, meaning onto the base area. As an alternative, also a reversed arrangement would be possible that the armature bearing engages the armature from above and the contact springs extend beneath the actuators.

By means of the fact that the contact springs and the armature bearing each engage the armature body on two sides of the armature facing away from each other, it is ensured that the armature is pressed into the armature bearing if the relay would like to switchover, meaning the armature should be tilted around the armature bearing axis, however, this is not possible because one contact is welded, meaning an opening failure occurs. The armature is then pressed by the contact spring on the side where the actuator should open the defective contact into the direction of the armature bearing and, on the other side, the armature is pressed downwards by magnetic force so that the armature overall is automatically pressed into the armature bearing in the case of such a failure. This ensures that the armature is always held in the correct position and it would not even be necessary to hold the armature up within the armature bearing, for example, by means of a corresponding counter bearing in the relay housing etc. Thereby, it is ensured that the second contact is securely held open if the contact to be opened cannot be opened.

As has already been mentioned, the winding axis of the coil, the armature bearing axis and a main extension direction of the contact springs each extend, being particular preferred, in a flat manner, preferably primarily in parallel, above the base area of the main body of the relay housing, which is designed as a contact side for positioning the relay on a circuit board or a PCB. This base area or contact side is the surface, which, in the assembled state of the relay, is within or at a short distance over the circuit board lying in parallel. There are connectors or terminals accordingly arranged on the base area, for example, contact pins, SMD contact surfaces, etc. for the circuit board or the circuit. In other words, with reference to the PCB, the relay comprises a resting rotational axis of the armature and the armature and magnet assembly are located next to each other across the base area in a flat manner. Thereby, the spring movement plane lies primarily perpendicular on the base area, meaning the springs are moved away from the base area for opening and closing and are moved in the direction of the base area.

Provided that the relay, as is desired in the preferred embodiment, should be designed as a safety relay, one of the at least two contact springs is designed as part of a normally open contact and the other one of the at least two contact springs is designed as part of a normally closed contact, which is allocated to this normally open contact within an external safety switch. In the case of such a safety relay, the normally open contact and the normally closed contact are arranged on the ends of the armature facing away from each other in its longitudinal direction, whereby, in addition to the to the forced guidance, a particularly large stroke can be implemented on both sides, meaning both on the normally open contact as well as on the normally closed contact.

Preferably, at least one of the actuators, particularly preferred, the actuator, which is allocated to the contact spring of the normally open contact, comprises a pinch projection extending in an opening direction of the contact springs, for example, in the form of a small projection, which presses against the contact spring in the open state (in the opening direction). In this way, it can be provided that it is ensured at all times that a mechanically connected NC contact has a contact distance of at least 0.5 mm if an NO contact is closed and also vice versa. In addition, however, the actuator of the normally closed contact can also have a corresponding pinch projection.

Preferably, at least one of the contact springs, being particularly preferred, the contact springs of the normally closed contact is designed as a double contact and comprises two contact elements, which abut a counter contact element in a closed position. This is particularly favourable in the case of a contact, via which signals should be transmitted, typically being the normally closed contact (NC contact), which should be closed in the normal position of the relay. Due to the design as a double contact, the likelihood can be increased that a contact for signal transmission of at least one of the two contact elements can be established with the counter contact element, for example, if dirt on a contact elements prevents good contacting between the contacts.

In the case of a simple base form of the relay, it suffices if the actuators are arranged in such a way that the respective contact springs can be pressed away in one direction, for example, being capable of being pressed away from the counter contact. In the counter direction, the movement of the contact springs takes place in a simple manner by means of the preload, which each contact spring has. That means the actuators then operator only against the preload of the contact springs and let these simply let themselves come back to a starting position, for example, the closed state of the respective contact, due to the intrinsic preload. This construction, where the actuator only engages the contact springs from one side, has the advantage entailing a simpler assembly of the relay.

In principle however, it is also possible to design the actuators in a fork shape, meaning that the contact spring allocated to the actuator is gripped around by the actuator from at least three sides. In the case of such actuators, the closing of a contact can also be supported or initiated depending on if the contact spring has a certain preload into one direction.

In order to simplify the assembly of the relay, thereby also making it more inexpensive, the main body preferably has catch elements in order to snap the coil system on or into the main body. The coil body can comprise corresponding mating catch means interacting with it or the catch elements are simply formed by surfaces or edges of the coil system, for example, of the coil body or of the pole surfaces of the yoke. Along the same lines, in a favourable manner, the armature can be snapped into the armature bearing of the main body using an armature bearing pin for example.

Being particularly preferred, the relay comprises a housing cover, which can be connected to the main body to form a closed housing. Thereby, the housing cover also comprises catch elements and the main body comprises mating catch means interacting with these in order to simply snap the housing cover to the main body, thereby making quick, easy and inexpensive assembly possible. Preferably, the housing cover also comprises counter bearing elements on the inside in order to hold the armature within the armature bearing of the main body. These counter bearing elements then block the armature from sliding out of the armature bearing.

Figure 2:
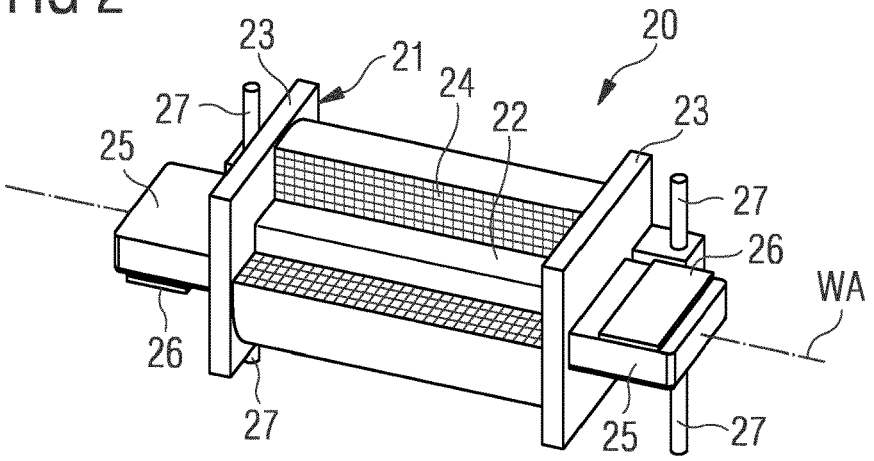
Figure 3:
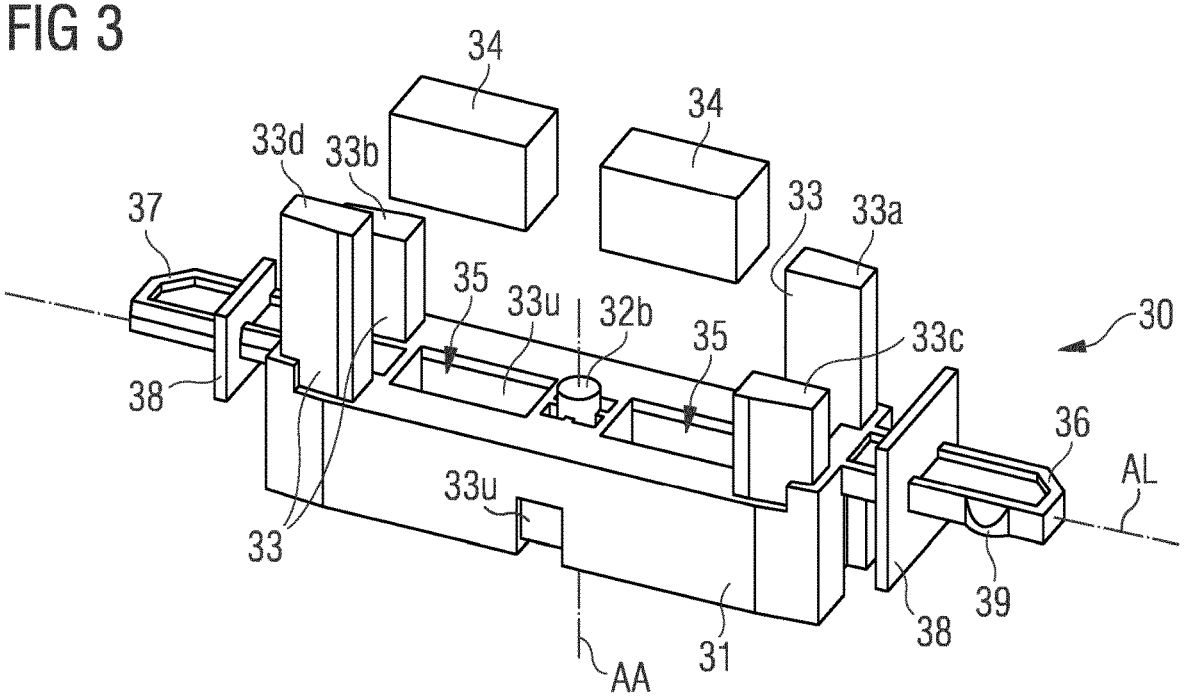
Figure 4:
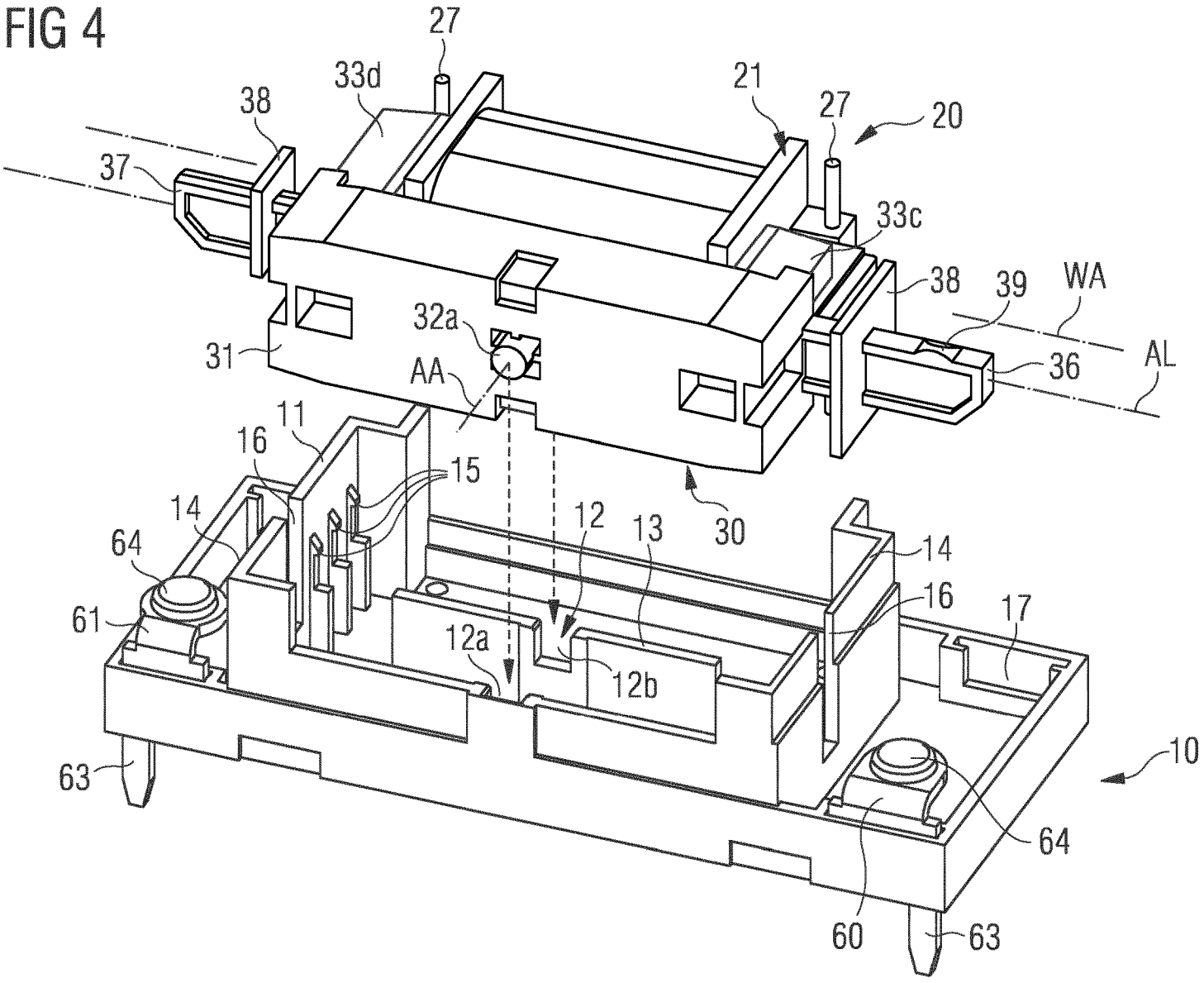
Figure 5:
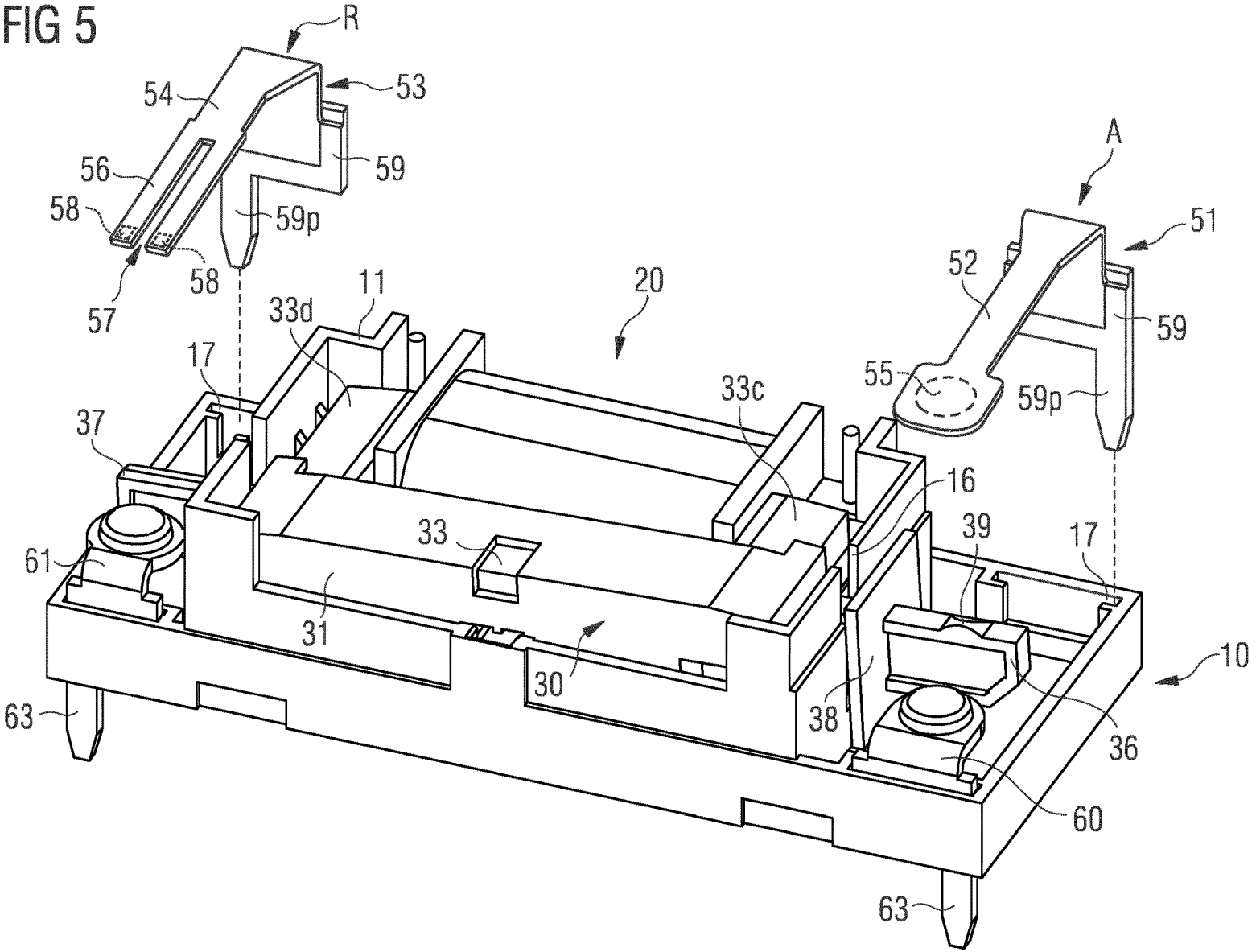
Figure 6:
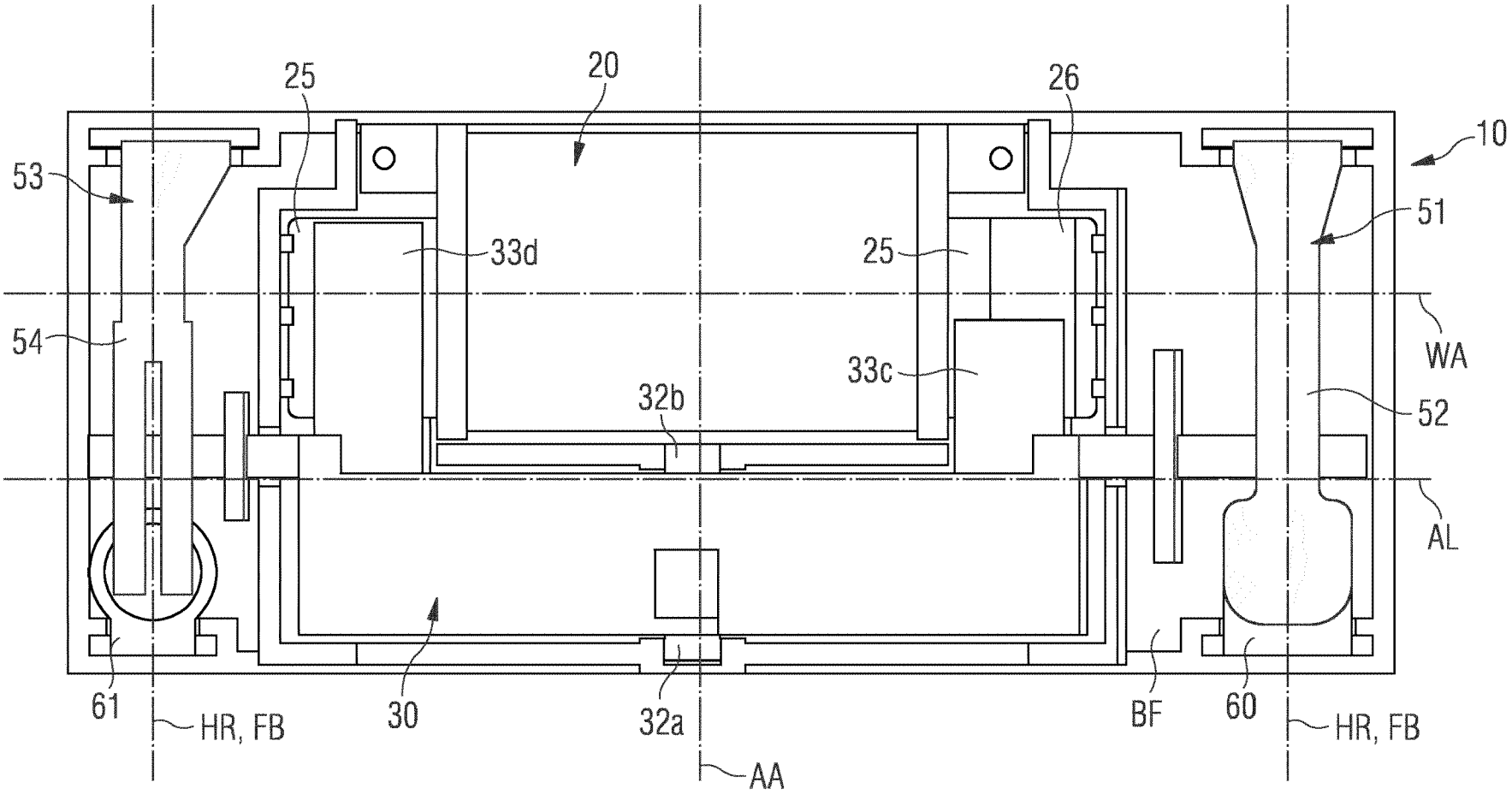
Figure 7:
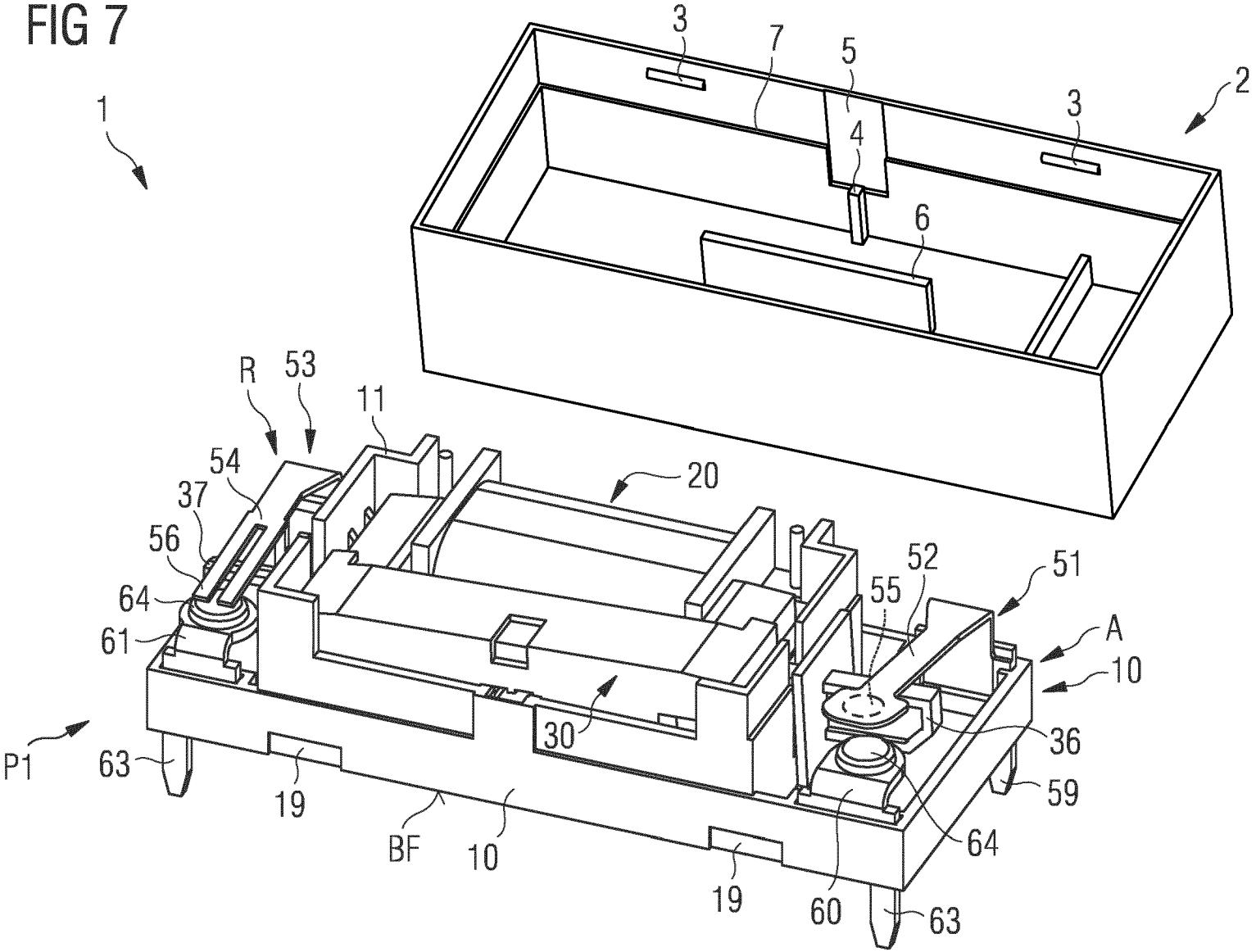
Figure 8:
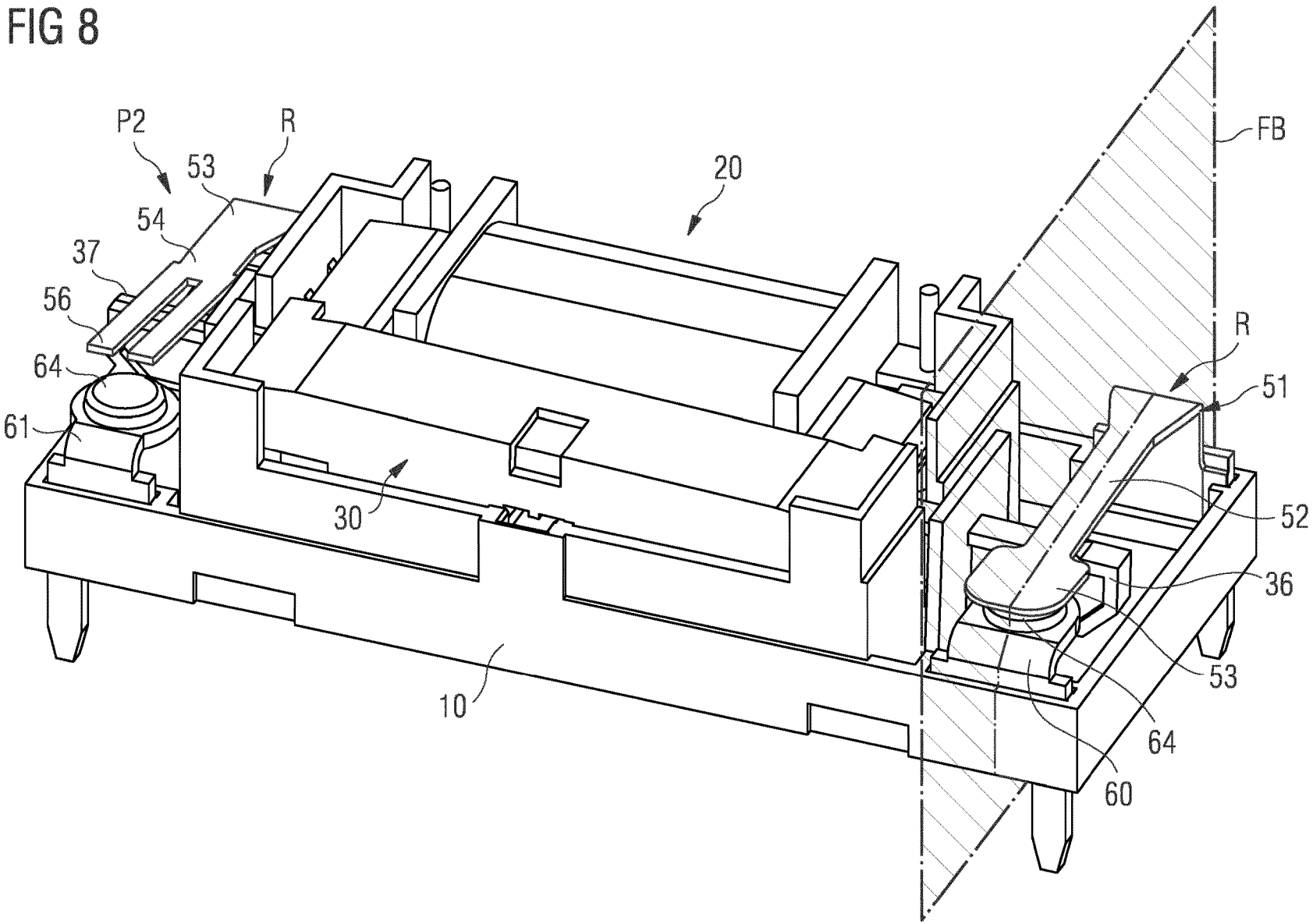

The invention is explained once again below with reference to the enclosed figures on the basis of exemplary embodiments. The figures show:

FIG. 1 an exploded view of the main body (with stationary counter contacts), of the coil system and of the armature of a first exemplary FIG. 2 an perspective view with a partial section through the coil system of the relay according to FIG. 1, FIG. 3 an exploded view of the armature of the relay according to FIG. 1, FIG. 4 an exploded view of the main body, coil system and armature of the relay according to FIG. 1, however, now, with the armature and coil system in the pushed-together state, FIG. 5 an exploded view of the main body, coil system and armature of the relay according to FIG. 1, however, now, with the armature and coil system in the main body and with the contact springs before installation into the main body, FIG. 6 a top view of the relay in accordance with FIGS. 1 to 5 (when the housing cover is open), FIG. 7 a perspective front view of the relay in accordance with FIGS. 1 to 6 in a first switching state (with a closed normally closed contact) with a housing cover arranged next to it for the relay, FIG. 8 a perspective front view of the relay in accordance with FIGS. 1 to 6 in a second switching state (with a closed normally open contact), shown here without a housing cover.

Figure 9:
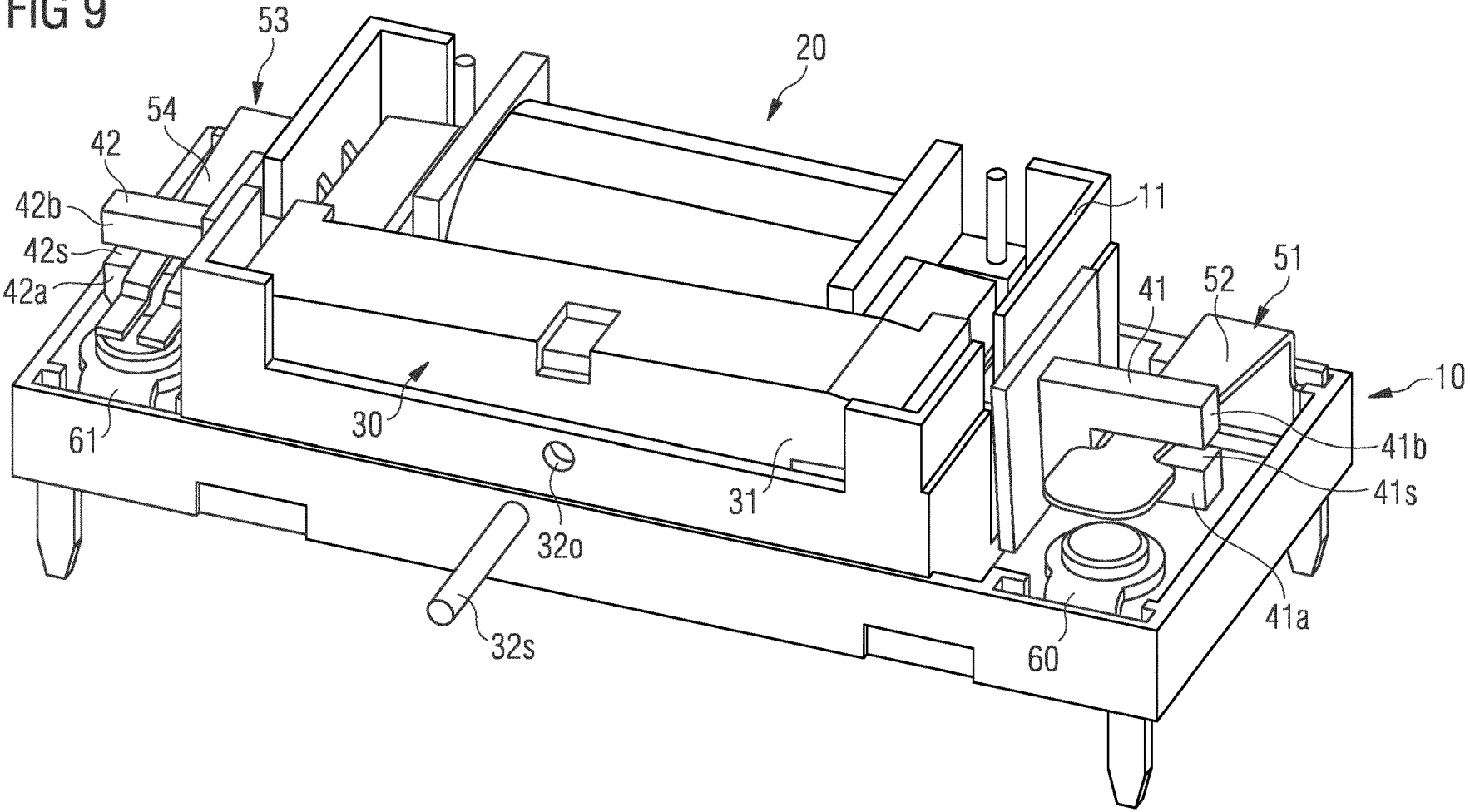
Figure 10:
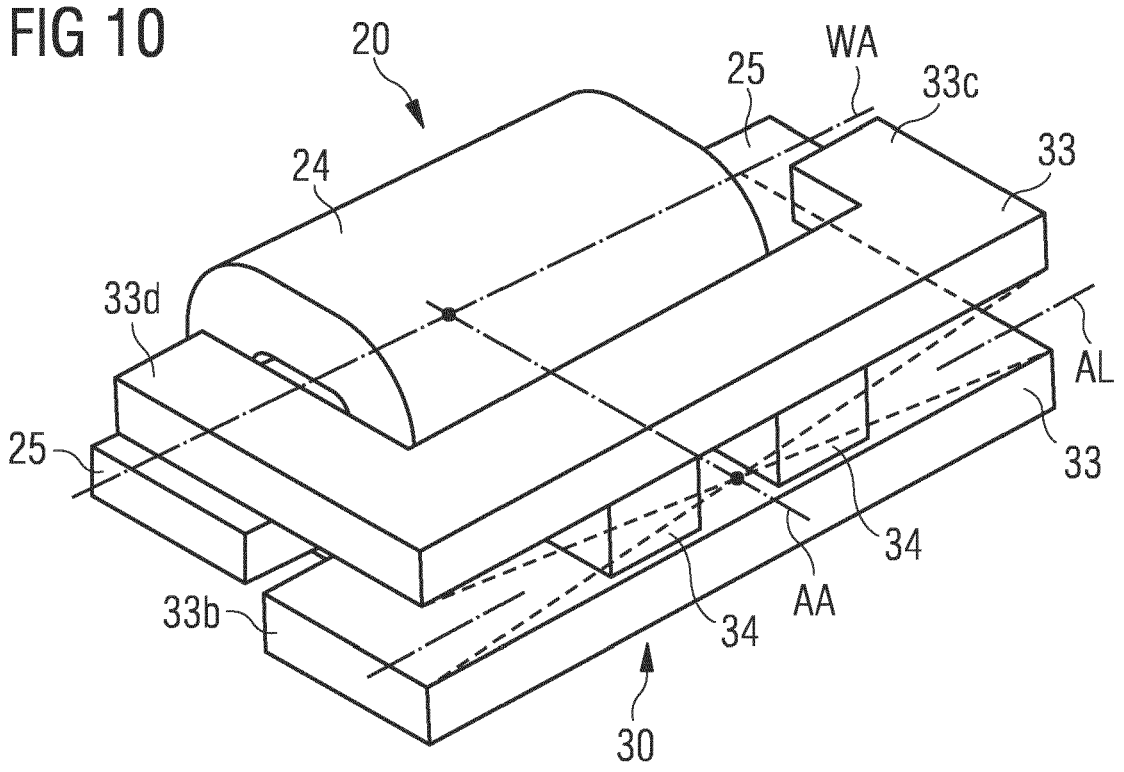

FIG. 9 a perspective front view of a second exemplary embodiment of a relay according to the invention, here, without a housing cover, FIG. 10 a schematic illustration of the coil system and of the armature of a relay according to FIGS. 1 to 8 or according to FIG. 9.

Figure 11:
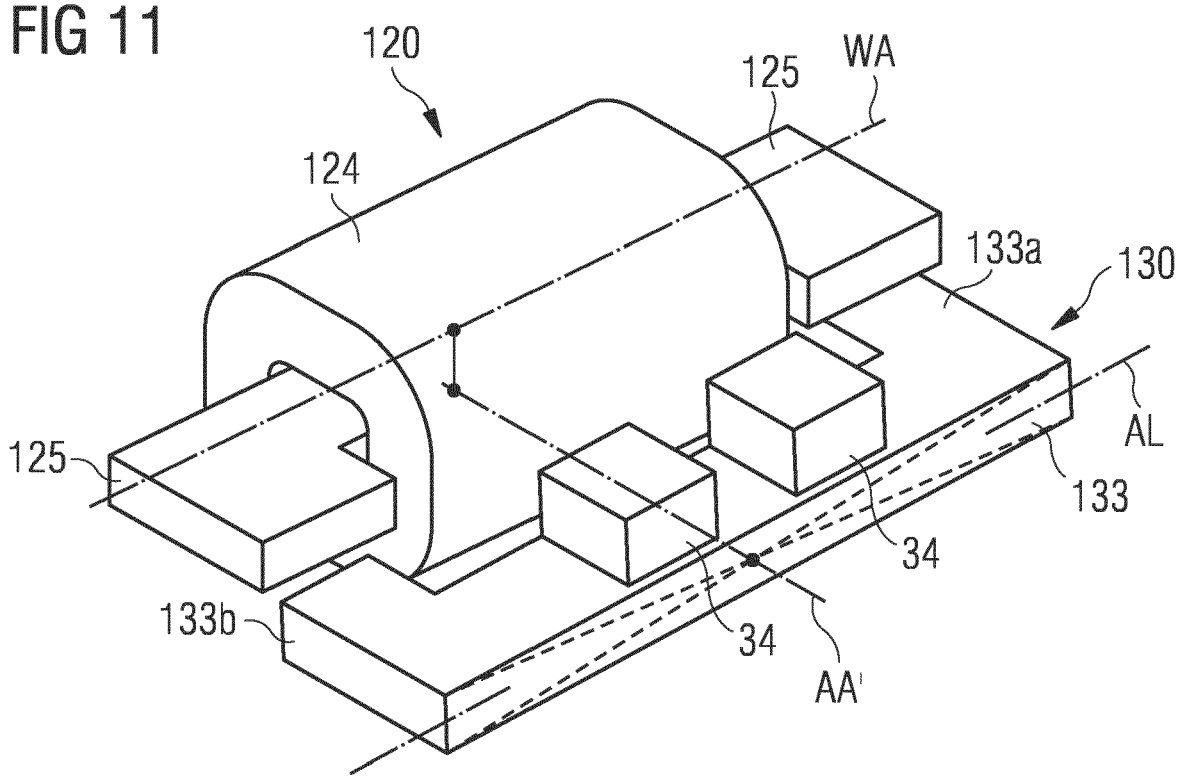

FIG. 11 a schematic representation of a coil system and of an armature of a relay in accordance with a third exemplary embodiment.

Based on FIGS. 1 to 8 as well as 10, now, initially a first preferred exemplary embodiment of the relay 1 according to the invention is described, wherein this relay 1 is designed signed as a safety relay with a normally open contact A and a normally closed contact R. As usual, in a de-energized or a non-energized state of the coil (meaning without an electric current), the relay is in a first switching state P1 (see FIG. 7), in which the normally closed contact is closed (normally closed) and the normally open contact A is open (normally open). In this state, the construction ensures that the contact element 55 of the contact spring 51 of the normally opening contact also has a minimum distance of 0.5 mm to the contact element 64 of the counter contact 60 in accordance with IEC 61810-3.

As is evident from the exploded view in FIG. 1, in addition to the contact spring 51, 53 of the normally open contact A and of the normally closed contact R, the main components of this relay 1 include a main body 10, in which all other components are assembled, a coil system 20 (also referred to as a coil assembly) and an armature 30 moveably coupled to it, which comprises two actuators 36, 37, by means of which the contact springs 51, 53 of the normally open contact A and the normally closed contact R can be actuated.

Based on the figure sequence in FIGS. 1, 4 and 5, it is furthermore evident how these components can be assembled to manufacture a relay 1.

For this purpose, initially, the stationary counter contacts 60, 61 of the normally open contact and the normally closed contact are inserted with their connection pins 63 (also referred to in the following as terminals 63) into main body 10 into corresponding break-throughs 18 on two corners of the main body 10. At a later process step, they are additionally casted for stronger fixation, for example, using an epoxy casting means. These stationary counter contacts 60, 61 are L-shaped, wherein the long L-limbs form the terminals 63 and comprise (as short L-limbs) counter contact sections 62 bent at the top towards a centre longitudinal axis of the main body 10, which are somewhat horizontal, preferably being precisely horizontal and are provided with counter contact elements 64 on their upper side. These counter contact elements 64 are, for example, made of a silver alloy, which can be riveted or welded to the counter contact section 62. The main body 10 then comprises the status shown in FIG. 1.

Then, the coil system 20 and the armature 30 are brought into the appropriate position towards each other, as this is shown in FIG. 4, mounted within the main body 10, which, as will still be explained in the following, can take place by means of a simple snap connection.

The construction of the coil system is shown more precisely in FIG. 2. As is evident from the partial section shown there, a yoke made of soft iron is initially moulded around with plastic within the scope of an injection-moulding process, wherein the mould is shaped in such a way that the coil body 21 is drum-shaped with a coil body core 22 centrally running in the longitudinal direction of the yoke 25 and two coil body flanges 23, wherein the end sections of the yoke 25 each protruded from the coil body flanges 23. The upper and lower surfaces of the open end sections of the yoke 25 form the pole surfaces of the yoke 25. Then, the coil 24 is wrapped onto the coil body core 22 between the coil body flanges 23. The coil body flanges 23 each have connection pieces on the outside, which hold coil connection wires 27, with which an electric contacting of the coil winding is possible. Corresponding holes in the base area BF or base plate are in the main body 10, through which the ends of these coil connection wires 27 are inserted in order to connect them to corresponding connectors of a circuit on a circuit board.

In the case of this construction, it has been ensured that the centre axis of the yoke 25 is simultaneously the winding axis WA of the coil 24, meaning that the yoke 25 centrally runs through the coil 24.

The appropriate armature 30 for this comprises corresponding pole shoes 33*a*, 33*b*, 33*c*, 33*d*, which, in the assembled state, each abut the pole surfaces of the yoke 25 or are distanced away from this via a defined air gap, depending on the position of the armature 30 relative to the coil system 20, meaning depending on the switching state P1, P2 of the relay 1.

To form these pole shoes 33*a*, 33*b*, 33*c*, 33*d*, the armature comprises two U-shaped soft-iron core elements 33, which are overmoulded around with plastic to form an armature body 31 within the scope of an injection-moulding method. This can be recognized particularly well in FIG. 3. The soft-iron core elements 33 are U-shaped and are arranged towards each other in such a way that their U-bars 33*u* and U-limbs run in parallel. On the side facing towards the coil system 20 in the assembled position, two cavities 35 remain in the armature body 31 during injection-moulding, into which permanent magnets 34 can be glued in. These cavities 35 comprise a width, which corresponds to the distance between both U-shaped iron core elements 33. The U-limbs preferably each have different heights and bold U-shaped iron core elements 33 are arranged in such a way that a shorter U-limb as a shorter pole shoe 33*c*, 33*b* always lies opposite to a longer U-limb as a longer pole shoe 33*a*, 33*d*.

In the assembled position, a longer pole shoe 33*a*, 33*d* and another shorter pole shoe 33*b*, 33*c* of the armature 30 lie opposite to one another onto diagonally opposite pole surfaces of the yoke 25 of the coil system 20 respectively. This can also principally recognized again in FIG. 10.

Due to the armature bearing pins 32*a*, 32*b* (see FIGS. 1 and 3) overmoulded onto the armature body 31 as well as due to appropriate positioning of the armature bearing sections 12*a*, 12*b* of an armature bearing 12 in the main body 10, and armature bearing axis AA is defined, which precisely intersects the centre axis of the yoke 25, which, as mentioned before, corresponds to the winding axis WA of the coil 24. This can also be schematically recognized particularly well in FIG. 10. This special arrangement of the armature bearing axis AA towards the winding axis WA and the centre axis of the yoke 25 here securely provides for an even resting of the diagonally opposite edges of the armature pole services on the yoke 25.

This magnet system (consisting of a coil system 20 and an armature 30) as four operating air gaps. Thereby, the long pole shoes 33*a*, 33*d* are arranged in such a way that, in the switch position P1 shown in FIG. 7, in which no current is applied to the coil 24, meaning the normally closed contact R is closed, these pole shoes 33*a*, 33*d* abut the pole surfaces of the yoke 25 allocated to them. By means of this, in this direction, a particularly strong attraction force is achieved. If the coil 24 is flowed through with current, meaning energized, a polarization opposing the permanent magnet flow, which is present due to the magnetic flux of the permanent magnets across the armature iron element, is generated within the yoke. By means of this, these longer pole shoes 33*a*, 33*a* are repelled and the shorter pole shoes 33*b*, 33*c* are attracted by the yoke 25, wherein, due to additional distance spaces 26 on the pole surfaces of the yoke 25 allocated to these shorter pole shoes 33*b*, 33*c*, it is ensured that the magnetic flux is still somewhat reduced and that the attraction force is not quite as strong as in the closed state of the normally closed contact R. This makes it easier to switch back to close the normally closed contact R.

Two actuators 36, 37 are radially moulded on the armature body 31 in the form of short stub-like actuator arms in the longitudinal direction AL of the armature 30 outwardly from the armature bearing axis AA. These radially extend from the armature bearing axis AA so far outwardly that they project over the ends of the U-shaped iron core elements 33 on the outside, meaning they protrude over the points at which the U-limbs are bent away from the U-bar 33*u*. By means of this, the actuators 36, 37 are radially further away from the armature bearing axis AA than the pole shoes 33*a*, 33*b*, 33*c*, 33*d*. As can be recognized from the figures, this ensures that, in the case the armature 30 is tilted around a relatively small path or armature stroke in the region of the pole shoes 33*a*, 33*b*, 33*c*, 33*d*, a relatively large path or armature stroke with relation to this in the region of the actuators 36, 37 is slid over and there, the stroke, with which the actuators 36, 37 can move the contact springs 51, 53 and consequently, a distance between the contact springs 51, 53 to the counter contact elements 64 of the stationary counter contacts 60, 61 can be relatively great despite the very small flat design height of the overall relay 1.

In order to couple the coil system 20 and the armature 30 to the main body 10, and thereby, also to couple the coil system 20 and the armature 30 to each other, the main body 10 comprises a frame 11 on a base area BF, by means of which the relay 1 later, in the assembled state, can be arranged on a circuit board or the like and from which the terminal 63, 59 of the various contacts and the coil connectors 27 of the coil protrude. The coil system 20 and the armature 30 are in the appropriately pressed together state in this frame 11 so that the pole surfaces of the pole shoes 33*a*, 33*b*, 33*c*, 33*d* appropriately lie in front of the pole services of the yoke 25, being precisely adaptable.

For this purpose, the frame 11 comprises two side walls 14, in which catch elements 15 are located internally, by means of which the coil system 20 can be snapped between the side walls 14 by pressing it in, wherein the catch elements engage onto the upper edge of the ends of the yoke 25 in the form of latch elements. These catch elements 15 each comprise precise contact surfaces, on which the yoke 25 rests with its lower edges so that the entire coil system 20 is appropriately positioned.

Furthermore, this frame 11 comprises slots 16 in the side walls 14 respectively, through which the actuators 36, 37 of the armature 30 can protrude through. A front wall of the frame 11 connecting the side walls 14 in FIG. 1 in the front comprises an armature section 12*a* at a centre position, which forms the part of the armature bearing 12, in which the armature bearing pin 32*a* of the armature 30 facing away from the pole shoes 33*a*, 33*b*, 33*c*, 33*d* is accommodated. In order to mount the inner armature bearing pin 32*b* between the pole shoes 33*a*, 33*b*, 33*c*, 33*d* facing the direction of the coil system 20, there is an armature bearing bar 13, in which a corresponding armature bearing section 12*b* of the armature 12 is arranged, thereby extending away from the base area BF of the main body 10 upwardly, being parallel to the front wall of the frame 11.

As is shown in FIG. 4, therefore, the armature 30 and the coil system 20 only need to be appropriately placed on top of one another in a loose manner and the entire assembly can be snapped together in the frame 11 of the main body 10. This position is shown in FIG. 5. As can be seen here, the actuators 36, 37 are long enough that they are positioned with their ends before the upper short L-limbs of the counter contacts 60, 61. In order to shield the contacts A, R against the magnet system, meaning against the coil system 20 and the armature 30 and its magnetic parts, the actuators 36, 37 comprise flat shielding elements 38 at a short distance from the side walls 14 of the frame 11 of the main body 10 to the counter contacts 60, 61 located outside of the frame 11 which covered the slot 16 for the actuators 36, 37 in the side walls 14 of the frame 11. Thereby, the insulation routes (air route and creep rout) between the contacts A, R and the magnetic components and electrical components of the coil system 20 and of the armature 30 are enlarged.

If the coil system 20 and the armature 30, as is shown in FIG. 5, are assembled, the moveable contact springs 51, 53 of the contact system 50 are assembled. For this reason, the contact springs 51, 53 are attached to the spring holders 59, for example, riveted or welded, which are respectively designed as terminals 59*p* or pins 59*p* (similar to the terminals 63 of the counter contacts 60, 61) on their lower end facing towards the main body 10. Corresponding recesses 17, through which the terminals 59*p* are inserted and can be simultaneously fixed within the main body 10, are located in the main body 10 across from the recesses 18 to insert the stationary counter contacts 60, 61. At a later process step, they are also additionally casted for stronger fixation, for example, using an epoxy casting means. The contact springs 51, 53 are each constructed in an L-shape, exactly like the counter contacts 60, 61, wherein, here, however, the upper L-limb is considerably longer than the L-limb attached to the spring holder 59. That means, here, a spring section 52, 54 extends on the top from the terminal 59 respectively, at which a contact element 55, 58 is respectively arranged on the end in the direction of the counter contacts 60, 61 (i.e. in FIG. 5, on the bottom side of the ends of the contact springs 51, 53 respectively), which is provided for contacting with the counter contact element 64 of the respective counter contacts 60, 61. The contact element 55, 58 can also be made of a silver alloy like the counter contact element 64 for example and can be welded or riveted to the respective end of the contact spring 51, 53.

In the first exemplary embodiment of a relay 1 according to the invention described here, the contact spring 51 one of the normally open contact A as a relatively large contact element 55, which is attached to an expansion arranged on the end of the spring section 52.

In contrast, the contact spring 53 of the normally close contact R comprises a divided contact surface 56 with two small contact elements 58 (smaller than the contact element 55 of the contact spring 51 one of the normally open contact A) on its spring section 54 on the inside, while a slot 57 runs in the longitudinal direction of the spring section 54 starting from the end. This has the advantage that the normally closed contact R maintains sufficient contact to the counter contact element 64 with a high level of certainty in order to make signal transmission possible.

The longitudinal direction of the two spring sections 52, 54 of the contact springs 51, 53 is the main extension direction HR of the contact springs 51, 53. It runs here, as can, in particular, be seen from FIG. 6, almost parallel to the armature bearing axis AA of the armature 30 and perpendicular to the winding axis WA of the coil system 20. As can be seen here, the longitudinal axis of the armature AL runs in parallel to the winding axis WA of the coil 24 of the coil system 20. All mentioned longitudinal axes and main extension directions run in a primarily flat manner above the base area BF of the main body 10, whereby the particularly flat design of the relay 1 results. It is clear that the spring sections 52, 54 deviate a little from this main extension direction depending on the position of the contact concerned A, R, meaning if the contact concerned, A, R is closed or open, i.e. that they do not run exactly parallel to the armature bearing axis AA and can be bent away upwardly or downwardly with relation to the base area BF of the main body 10. However, the spring movement plane FB, within which the flexible spring section 52, 54 of the contact spring concerned 51, 53 is moved in the case of an actuation, is primarily perpendicular to this base area BF and in parallel to the armature bearing axis AA or also primarily perpendicular to the winding axis WA of the coil 24 of the coil system. This movement plane FB is schematically shown in FIG. 8 once for the normally open contact.

As is quite evident from FIGS. 5 to 7, the spring sections 52, 54 are designed in such a way and the contact springs 51, 53 are positioned in such a way that they bridge the actuators 36, 37 at the ends of the armature 30 from above respectively. That means the actuators 36, 37 press against the respective spring sections 52, 54 when pressed from below.

In the "normal state" of the relay shown in FIG. 7, meaning without current flowing through the coil 24, the armature 30 is in a position that is tilted in such a way that the normally closed contact R is closed, meaning the actuator 37 on the side of the normally closed contact R is tilted downwardly and the actuator 36 on the side of the normally open contact is tilted upwardly. In the case of the normally open contact A, in order to ensure that the contact distance between the counter contact element 64 of the counter contact 60 and the contact element 55 of the contact spring 51 is large enough, the actuator 36 comprises a small projection 39 to form a pinch projection 39 on its upper side precisely under the spring section 52 in the assembled state so that the spring section 52 is still further lifted from the counter contact element 64 of the counter contact 60 in the normal state shown in FIG. 7. The minimum distance here is also 0.5 mm, even in the case of failure in accordance with IEC 61810-3. Both contact springs 51, 53 or their spring sections 52, 54 are designed in such a way that they have a preload, which ensures that the contact elements 55, 58 of the contact springs 51, 53 would be pressed against the counter contact element 64 of the counter contact 60, 61 without external force, meaning without an actuator 36, 37 acting on the spring sections 52, 54

FIG. 8 shows the relay in a second switch position P2, where current is applied to the coil 24, whereby the polarity of the magnetic field of the yoke 25 is reversed and the armature 30 has therefore been tilted into a position while the actuator 37 lifts the contact spring 53 of the normally closed contact R away from the counter contact 61, and thereby, opens the normally closed contact R, wherein, simultaneously, the contact spring 51 one of the normally open contact A contacts the counter contact 61 allocated to it due to its preload and thereby, the normally open contact A is closed. The distance between the contact elements on the side of the normally closed contact R is then at least 0.5 mm, even in the case of failure in accordance with IEC 61810-3.

The arrangement of the contact springs 51, 53 with relation to the actuators 36, 37 has been selected here in such a way that, in the closed state, the contact springs 51, 53 do not come into contact with the allocated actuator 36, 37 so that, even in the case of the counter contact elements 64 burning down, reliable contacting is still possible and the actuator keeps the respective contact spring 51, 53 away from the counter contact element 64 when not in the closed position.

As is shown in FIGS. 7 and 8, in the finished assembled state of all components, the relay 1 can ultimately be sealed with a housing cover 2. This comprises a circumferential wall, the inner dimension of which are adapted to the outer dimensions of the main body 10. The main body 10 comprises two latch cut-outs 19 outside on the bottom in the direction of the base area BF on its two longitudinal sides respectively, which interact with corresponding snap-fit elements 3 on the inside of the wall of the housing cover 2 and by means of which, the housing cover 2 can be snapped onto the main body 10. Furthermore, on the inside of the wall of the housing cover 2, there is a circumferential edge 7 and an appropriate height so that this circumferential edge 7 rests on a circumferential edge of the main body 10.

On a longitudinal side, there is a recess 5 on the centre of the outer wall of the housing cover on the inside, which is adapted to the front wall of the frame 11 of the main body 10 in the region of the armature bearing 12 so that, also here, there is an appropriate fit. On this side, a bar 4 extends along the inner wall of the housing cover 2 from the upper top wall of the housing cover 2 in the direction of the recess 5, the said bar 4 serving as a counter bearing element for the armature bearing section 12*a* of the armature bearing 12, thereby holding the armature bearing pin on the side of the armature 20 facing away from the coil system 20 in the corresponding armature bearing section 12*a*. Furthermore, the housing cover 2 comprises a bar 6, extending parallel to the longer side walls in approximately the centre region, which extends between the coil system 20 and the armature 30 in the assembled state and is used as a counter bearing element 6 for the armature bearing section 12*b* of the armature bearing 12 between the armature 30 and the coil system 20. Thereby, both armature bearing pins 32*a*, 32*b* are securely held in the armature bearing 12. However, due to the special construction, even in the case of opening failure, the armature 30 springing out of the armature bearing 12 is not possible since, here, it is ensures that the spring sections 52, 54 of the contact springs 51, 53 extend across the actuators 36, 37 in a bridge-like manner and the armature 30 with the armature bearing pins 32*a*, 32*b* is pressed in from above into the armature bearing sections 12*a*, 12*b* of the armature bearing. That means that the armature bearing 12 and the contact springs 51, 53 engage the armature 30 from various sides, thereby providing stabilisation. If the actuator 36, which should actually open when the coil 24 is switched on, is held in position by a welded contact spring, on the other hand, the armature 30 is magnetically pressed into a position, in which the opposite actuator 37 is also pressed down, due to applying current to the coil 24. This offers an additional safeguard.

In FIG. 9, a modified variant of the relay 1 in accordance with the FIGS. 1 to 8 can be seen. The coil system 20 and the armature 30 with its magnetic components are primarily constructed in the same way as is the case with the first exemplary embodiments in accordance with FIGS. 1 to 8. However, here, the actuators 41, 42 are constructed in a fork-like manner with a lower section 41*a*, 42*a* and an upper section 41*b*, 42*b* and a slot 41*s*, 42*s* respectively running in between in the longitudinal direction AL of the armature 30. The respective contact springs 51, 53 or the spring section 52, 54 of the contact springs 51, 53 runs through the respective slot 41*s*, 42*s* of the actuator 41, 42 allocated to it. This construction makes it possible for the spring sections 52, 54 of the contact springs 51, 53 to not only be lifted away from the counter contact 60, 61 against their own preload, but also be able to be pressed downwardly against the counter contact 60, 61 by the upper section 41*b*, 42*b* of the actuator 41, 42 to close. This can be practical in the case of some applications, depending on the preload that the contact springs 51, 53 must have and on what purpose the relay should be used for.

In this case, also the armature bearing of the armature 30 is constructed somewhat differently. Instead of the armature bearing pins 32*a*, 32*b* moulded onto the armature body 31, now, there is an armature bearing bore hole 32*o* in the armature body 31 running in the direction of the armature bearing axis AA. Armature bearing bore holes 12*o* are also located at the matching position in the frame 11 in the centre armature bearing bar 13 (not shown in FIG. 9) of the main body 10. One armature bearing pin 32*s*, for example, a metal bolt, is then inserted through the bore hole in order to implement the armature bearing.

Independently of the embodiment of the actuators according to the aforementioned first variation in accordance with FIGS. 1 to 8 or the second variation in accordance with FIG. 9, the armature 30 (or the magnet system consisting of the armature 30 and the coil system 20) can also be designed in a different manner. This is schematically shown based on FIG. 11. As a comparison with FIG. 10 shows, considerable difference here exists in the fact that the armature 130 is not H-shaped with two U-iron-core elements, but only comprises such an iron core element 133 designed, for example, in a U-shape. That means the magnet system only has two operating air gaps and only a single pole shoe 133*a*, 133*b* abuts the corresponding pole surface of the yoke 125. In the present case shown, the yoke 125 is formed in such a way that it comprises enlarged pole surfaces on the ends respectively. In principle however, the magnet system 120 is otherwise constructed in the same way as the magnet system 20 in accordance with the first exemplary embodiment, as this has been particularly explained in conjunction with FIG. 2. That means that the yoke 125 here is also moulded around with plastic to form a drum-like coil body and then the coil 124 is wrapped around the yoke or the coil body in a centre region. Along the same lines, the armature 130 can be manufactured by means of overmoulding the U-shaped iron core element 133 with actuators 36, 37 moulded on within the scope of a plastic injection-moulding method and the permanent magnets 34 are inserted to corresponding compartments 35. Since the armature 133 only comprises two pole shoes 133*a*, 133*b*, which only abut the pole surfaces of the yoke 125 from one side, here, the underside, here, the armature bearing axis AA' can be further offset downwardly so that it is at a distance under the longitudinal axis of the yoke 125 or the winding axis WA. That means that the armature bearing pins would then have to be arranged accordingly deeper in an offset manner, respectively at the height of the armature bearing axis AA, which intersects the soft-iron core element or tits centre longitudinal axis. Accordingly, the main body must be designed in such a way that the armature bearing sections of the armature bearing are at a shorter distance above the base area BF. This other exemplary embodiment with a simplified armature 130 has the advantage that material is saved. This can also be of an advantage during assembly since the armature 133 and the magnet system 120 can be inserted into the main body independently of one another.

The construction of all exemplary embodiments shown in the above have the advantage that all components of the relay 1 can be assembled very quickly and easily by means of snap connections, wherein, with the snap connection, all important safety requirements of a safety relay are fulfilled.

In conclusion, it is again pointed out that in the case of the apparatuses described above in detail, these only have to do with exemplary embodiments, which can be modified by the person skilled in the art in various ways without leaving the scope of the invention. For example, the armature bearing axis could also be outside of the iron of the armature or offset with respect to the armature longitudinal axis. Furthermore, the armature bearing can also be manufactured as a separate part, which is then, in turn, fixed within the main body and/or on the magnet system during assembly, for example, is a type of shaft, onto which the armature is set with a corresponding armature bearing bore hole. The armature bearing could also be moulded directly on the magnet system. Along the same lines, the elements, particularly interacting ones, can be interchanged on the front and on the back half shell or similar variations are possible. Furthermore, the special features of the variations described in the above can also be combined with one another if applicable.

In addition, the use of the indefinite article "a" or "an" does not rule out that several relevant features can also be available.

REFERENCE LIST

1 relay
2 housing cover
3 latch element
4 bar
5 recess
6 bar
7 edge
10 main body
11 frame
12 armature bearing
12*a*, 2*b* armature bearing sections
12*o* armature bearing bore
13 armature bearing bar
14 side wall
15 catch element
16 slot
17 recess
18 breakthrough
19 latch cut-out
20 coil system
21 coil body
22 coil body core
23 coil body flange
24 coil
25 yoke
26 distance space
27 coil connection wire
30 armature
31 armature body
32*a*, 32*b* armature bearing pin
32*o* armature bearing bore
32*s armature bearing pin*
33 soft-iron core element
33*u* U-shaped bar
33*a*, 33*b*, 33*c*, 33*d* pole shoes
34 permanent magnet
35 cavity
36 actuator
37 actuator
38 plate element
39 pinch projection
41 actuator
41*a* lower section
41*b* upper section
41*s* slot
42 actuator
42*a* lower section
42*b* upper section
42*s* slot
50 contact system
51 contact spring
52 spring section
53 contact spring
54 spring section
55 contact element
56 contact surface
57 slot
58 contact element
59 spring holder
59*p* terminal/pin
60 counter contact
61 counter contact
62 counter contact sections
63 terminal
64 counter contact element
120 magnet system
124 coil
125 yoke
130 armature
133 iron core element
133A, 133*b* pole shoe
A normally open contact
R normally closed contact
AA armature bearing axis
AA' armature bearing axis
AL longitudinal direction of the armature
BF base area
FB spring movement plane
HR main extension direction
WA winding axis
P1 first switch status
P2 second switch status

The invention claimed is:

1. An electromagnetic relay, preferably a safety relay, with a main body, a coil system located on the main body, the coil system having a coil and a yoke which extends through the coil along a winding axis of the coil, an armature, which is located next to the coil and mounted such that it can pivot about an armature bearing axis and has pole shoes for magnetically coupling with the yoke of the coil system, a contact system having at least two contact springs, wherein each spring movement plane of the contact springs extends across the winding axis of the coil, preferably at a substantially right angle, and at least two actuators arranged on the armature, which are allocated to the contact springs in order to actuate contact springs and which extend radially outwards on the armature with respect to the armature bearing axis in a longitudinal direction of the armature, wherein the radially outermost ends of the two actuators are each farther away from the armature bearing axis than the pole shoes of the armature.

2. The relay according to claim 1, wherein the spring movement plane of at least one of the contact springs runs primarily parallel to the armature bearing axis.

3. The relay according to claim 1, wherein the armature bearing axis runs through the coil.

4. The relay according to claim 1, wherein the pole shoes are bent away from the longitudinal direction of the armature to the coil.

5. The relay according to claim 1, wherein the actuators are permanently connected to the armature, preferably being designed as a single piece with the armature.

6. The relay according to claim 1, wherein the actuators and the contact springs are respectively designed and arranged in such a way that a contact spring is pressed away or pressed from or towards a counter contact allocated to the respective contact spring by the actuator allocated to it to open a contact.

7. The relay according to claim 1, with an armature bearing arranged on the main body, in which the armature is pivotably mounted around the armature bearing axis wherein, the armature bearing, on the one hand, and the at least two contact springs on the other hand, are arranged on sides of the armature opposite to each other with the actuators.

8. The relay according to claim 1, wherein the winding axis of the coil, the armature bearing axis and the main extension direction of the contact springs run respectively in a flat manner to a base area of the main body, which is designed as a contact side for positioning the relay on a circuit board.

9. The relay according to claim 1, wherein one of the at least two contact springs is part of a normally open contact and another of the at least two contact springs is part of a normally closed contact.

10. The relay according to claim 1, wherein at least one of the actuators, preferably the actuator that is allocated to the contact spring of a normally open contact, comprises a pinch projection extending in an opening direction of the contact spring, which presses against the contact spring in the open state.

11. The relay according to claim 1, wherein at least one of the contact springs, preferably the contact spring of a normally closed contact, is designed as a double contact and comprise two contact elements, which rest on a counter contact element in a closed position.

12. The relay according to claim 1, wherein at least one of the actuators is fork-shaped.

13. The relay according to claim 1, wherein the main body comprises catch elements in order to latch the coil system onto or into the main body.

14. The relay according to claim 1 with a housing cover, which can be connected to the main body to form a closed housing, wherein, preferably, the housing cover comprises catch elements and the main body comprises a mating catch means interacting with it in order to latch the housing cover to the main body, and/or wherein, preferably, the housing cover comprises counter bearing elements internally in order to hold the armature within the armature bearing.

15. An use of an electromagnetic relay according to claim 1 in a safety circuit.

* * * * *